United States Patent [19]

Clarke et al.

[11] 4,107,058

[45] Aug. 15, 1978

[54] PRESSURE GREASE COMPOSITION

[75] Inventors: George A. Clarke; Gary L. Harting, both of Westfield, N.J.

[73] Assignee: Exxon Research & Engineering Co., Linden, N.J.

[21] Appl. No.: 826,175

[22] Filed: Aug. 19, 1977

[51] Int. Cl.[2] ..... C10M 3/18; C10M 5/14; C10M 7/20; C10M 7/24

[52] U.S. Cl. ..... 252/18; 252/25; 252/32.7 E; 252/45

[58] Field of Search ..... 252/18, 25, 32.7 E, 252/45

[56] References Cited

U.S. PATENT DOCUMENTS

| | | | |
|---|---|---|---|
| 2,513,680 | 7/1950 | Schott et al. | 252/18 |
| 2,964,475 | 12/1960 | Morway | 252/18 |
| 2,967,151 | 1/1961 | Morway | 252/40.7 |
| 3,007,870 | 11/1961 | O'Halloran | 252/40.7 |
| 3,344,065 | 9/1967 | Giinsheimer et al. | 252/18 |
| 3,909,426 | 9/1975 | Horodysky et al. | 252/45 |

FOREIGN PATENT DOCUMENTS

| | | | |
|---|---|---|---|
| 1,189,837 | 4/1970 | United Kingdom | 252/25 |
| 1,230,106 | 4/1971 | United Kingdom | 252/25 |

*Primary Examiner*—Delbert E. Gantz
*Assistant Examiner*—Irving Vaughn
*Attorney, Agent, or Firm*—Eugene Zagarella

[57] ABSTRACT

A grease composition is provided having improved extreme pressure properties and comprising an additive package of an insoluble phosphorus compound and an oil soluble sulfur compound. The particularly useful insoluble phosphorus compounds include the alkali metal or alkaline earth metal salts of a phosphorus acid while the useful soluble sulfur compounds include sulfurized hydrocarbons and organometallic sulfur salts.

11 Claims, No Drawings

PRESSURE GREASE COMPOSITION

BACKGROUND OF THE INVENTION

This invention relates to an improved lubricating grease composition and more particularly to a grease composition having improved extreme pressure properties and comprising an additive package which contains a selected oil insoluble phosphorus compound and an oil soluble sulfur compound.

It is, of course, well known in the prior art that various metal soaps can be advantageously used in the preparation of lubricating greases from essentially any lubricating base oil stock and that the greases thus prepared will, generally, exhibit good grease properties and/or characteristics. While a number of grease compositions have been prepared with different combinations of metal soap thickening agents and base oils, there has been particular difficulty in obtaining a grease composition suitable for use in severe applications where extreme pressure properties are required such as in the lubrication of traction motor bearings, wheel bearings on cars with disc brakes, steelmill bearings, ball joints, slow moving bearings and the like. To alleviate this deficiency, several methods have, heretofore, been proposed for producing grease compositions which will exhibit the desired extreme pressure properties and such methods include the use of various "extreme pressure" additives. Additives which have been proposed include chlorinated compounds such as chlorinated waxes, lead-sulfur systems, heavy metal sulfides (solid lubricants) and soluble phosphorus-sulfur systems. While these systems do provide some effectiveness in extreme-pressure applications, they do have some drawbacks. In this regard the chlorinated compounds have not been widely used since they can result in undesirable corrosion and the lead-sulfur systems generally have limited use because of the adoption of recent environmental protection standards.

SUMMARY OF THE INVENTION

Now it has been discovered that a lubricating grease composition having improved extreme pressure properties is provided when an additive package comprising an inorganic, oil insoluble phosphorus compound and an oil soluble sulfur compound is incorporated therein. More particularly this invention involves an additive package for a lubricating grease composition which comprises the combination of an alkali metal or alkaline earth metal salt of a phosphorus acid and a sulfurized hydrocarbon or an organometallic sulfur salt.

Accordingly, it is an object of this invention to provide a lubricating grease composition having improved extreme pressure properties. It is another object of this invention to provide an additive package for a lubricating grease composition to improve the extreme pressure and load carrying properties thereof. These and other objects and advantages will become apparent from the disclosure set forth hereinafter.

In accordance with the present invention, the foregoing and other objects and advantages are accomplished with a lubricating grease composition comprising a major proportion of a base oil stock, a thickener and an additive package made up of at least one oil insoluble phosphorus compound selected from the group consisting of alkali metal and alkaline earth metal salts of a phosphorus acid and at least one oil soluble sulfur compound selected from the group consisting of sulfurized hydrocarbons and organometallic sulfuric salts.

DETAILED DESCRIPTION OF THE INVENTION

As previously indicated, the present invention relates to a grease composition exhibiting improved extreme pressure properties which is particularly imparted with a multi-component additive package comprising at least one insoluble phosphorus compound and at least one soluble sulfur compound.

In general, any of the alkali metal or alkaline earth salts of a phosphorus acid may be used as the insoluble phosphorus component in the multi-component additive of the present invention. More particularly the insoluble phosphorus compound may be a salt of an alkali metal such as lithium, sodium or potassium or an alkaline earth metal such as calcium, strontium, barium or magnesium. Such salts, then, include both the acid and neutral salts of hypophosphorus acid, phosphorus acid, hypophosphoric acid, orthophosphoric acid, pyrophosphoric acid, and metaphosphoric acid. Since the use of acidic salts can, however, lead to undesirable corrosion, the use of neutral salts is preferred. Moreover, while satisfactory results are obtained when any one or a mixture of the alkali or alkaline earth metals is used, best results are achieved when a calcium salt of one of the phosphorus acids is used, particularly tricalcium phosphate.

Generally, any oil soluble sulfur containing compound may be used in the additive composition of this invention. More particularly, the soluble sulfur compounds which are suitable for use in this invention include the sulfurized hydrocarbons and organometallic sulfur salts. Compounds of this type include saturated and unsaturated aliphatic as well as aromatic derivatives and will generally have from 1 to 32, preferably 1 to 22 carbon atoms. Included in this group of oil soluble sulfur compounds are alkyl sulfides and alkyl polysulfides, aromatic sulfides and aromatic polysulfides, e.g. benzyl sulfide and dibenzyl disulfide, organometallic salts of various sulfur containing acids such as the metal neutralized salts of dialkyl dithiophosphoric acid, e.g. zinc dialkyl dithiophosphate as well as phosphosulfurized hydrocarbons and sulfurized oils and fats. Sulfurized and phosphosulfurized products of various polyolefins are particularly effective.

One particularly useful group of sulfurized olefins or polyolefins are those prepared from aliphatic or terpenic olefins having a total of 10 to 32 carbon atoms in the molecule and these materials are generally sulfurized such that they contain from about 10 to about 60 weight percent sulfur. The aliphatic olefins will include mixed olefins such as cracked wax, cracked petrolatum or single olefins such as tridecene-2, octadecene-1, eikosene-1 as well as polymers of aliphatic olefins having from 2 to 5 carbon atoms per monomer such as ethylene, propylene, butylene, isobutylene and pentene. The terpenic olefins will include terpenes ($C_{10}H_{16}$), sesquiterpenes ($C_{15}H_{24}$) and diterpenes ($C_{20}H_{32}$). Of the terpenes, the monocyclic terpenes having the general formula $C_{10}H_{16}$ and its monocyclic isomers are particularly useful.

The above described sulfurized and phosphosulfurized compounds may be prepared by techniques well known in the prior art. Such techniques include direct reaction with sulfur, especially where the hydrocarbon is unsaturated, reaction with phosphorus pentasulfide and similar reagents.

In general, any of the lubricating oil base stocks known to be effective in the preparation of grease compositions can be used in the grease compositions of the present invention. Such base oil stocks include the conventionally used mineral oils, synthetic hydrocarbon oils and synthetic ester oils. In general, these lubricating oils will have a viscosity in the range of about 35 to 300 SUS at 210° F. (99° C.). Mineral lubricating base stocks used in preparing the greases can be any conventionally refined base stock and the same may be derived from paraffinic, naphthenic and mixed base crudes. Synthetic lubricating oils that can be used include esters of dibasic acids, e.g. di-2-ethylhexyl sebacate esters of glycols such as $C_{13}$ oxo acid diester or tetraethylene glycol or complex esters such as those formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g. alkylated bottoms from the alkylation of benzene with tetrapropylene, or the polymers and copolymers of olefins; silicone oils, e.g. ethyl phenyl polysiloxanes, methyl polysiloxanes, etc.; polyglycol oils, e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups (see U.S. Pat. No. 3,424,678, column 3).

As also indicated previously, the lubricating base oil stocks used in the grease compositions of the present invention can be thickened with essentially any of the thickeners known to be effective in the prior art. Such thickeners include the alkali and alkaline earth metal and aluminum soaps and particularly those of sodium, lithium, calcium, barium and aluminum. As is well known, these soaps may be prepared with any of the fatty acids as well as esters of these fatty acids. As is also well known, these esters may contain substituted polar groups such as epoxy, hydroxy and the like. Moreover, these soaps may be used alone, in mixtures thereof and in combination with other additives known to improve the thickening operation or the product therefrom.

As is well known, thickening is generally accomplished by combining between about 2 to about 40 wt. % of the thickener into the base oil stock. The base oil-soap combination is then heated to a temperature within the range from about 75° C. to about 275° C. and held from between about 10 to 60 minutes and then cooled. The thickener may also be formed "in situ" by adding a suitable fatty acid or mixture thereof to the oil followed by neutralization with one or more suitable alkali, alkaline earth metal or aluminum compounds. Lithium hydroxide is, of course, commonly used to effect the neutralization. When this technique is employed, water is driven off during the heating step.

In general, the additive combination of this invention may be incorporated into the grease in essentially any suitable fashion. For example, both additives could be added to the base oil stock prior to thickening or both could be added after the thickening has been completed. In this regard, it should be noted that best results will be achieved if both are added after the thickening operation is completed but while the thickened grease remains at an elevated temperature, generally, between about 50° and 135° C. The grease can, of course, be agitated and/or milled to effect even distribution. Addition of the dual component additive after the thickening operation is completed will, of course, avoid any possible interference with the neutralization reaction.

The insoluble alkali metal or alkaline earth metal salt of a phosphorus acid is generally combined into the grease at a concentration within the range from about 0.3% to about 15% and preferably from about 0.5% to about 5.0% by weight based on total weight of grease composition. The soluble sulfur compound, on the other hand, is combined into the grease at a concentration within the range from about 0.05% to about 5% and preferably from about 0.1% to about 3.0% by weight based on the total weight of grease composition.

In a preferred embodiment, a neutral calcium salt of phosphoric acid and specifically tricalcium phosphate is used in combination with an olefin polymer which has been sulfurized so as to contain from about 40 to about 50 wt. % sulfur. The resulting additive combination will be used as an extreme pressure agent in a grease composition which has been thickened with a lithium or aluminum soap. In this regard, and for purposes of this invention, it should be noted that in a particularly preferred embodiment, the grease will be thickened with a lithium soap derived from a fatty acid containing a functional group and at least one dilithium soap derived from a straight chain dicarboxylic acid.

Preferably the fatty acid will be a hydroxy-substituted fatty acid having about 8 to about 30 carbon atoms, however, epoxy substituted acids and/or ethylenically unsaturated fatty acids could be used in a manner taught in U.S. Pat. No. 3,985,662. In a most preferred embodiment, 12-hydrostearic acid will be used in the preparation of the monolithium soap.

The dicarboxylic acids which will be used in the preferred embodiment to prepare the dilithium soap will have from 4 to 12 carbon atoms, more preferably 6 to 10 carbon atoms. Such acids include succinic, glutaric, adipic, suberic, pimelic, azelaic, dodecanedioic and sebacic acids. Sebacic acid and azelaic acid are most preferred.

Other preferred embodiments as well as a description of how to prepare the preferred lithium soap as defined above, is disclosed in the aforenoted U.S. Pat. No. 3,985,662.

Having thus described the present invention, it is believed that the same will become even more apparent by reference to the following examples which are included for purposes of illustration and which are in no way intended to limit the scope of the invention.

EXAMPLE 1

In this example, 4.4 parts of 12-hydroxystearic acid triglyceride and 4.4 parts of tallow fatty acids were added to 66.3 parts of naphthenic base oil stock having a viscosity of about 500 SUS at 100° F. (18° C.) and then neutralized with 1.4 parts of lithium hydroxide. The resulting formulation was then heated to a temperature of 320° F. (152° C.) for 5 minutes and 20.0 parts of a dewaxed paraffinic base oil having a viscosity of about 210 SUS at 210° F. (99° C.) was added. The resulting grease was then cooled to room temperature and milled. Three (3.0) parts of tricalcium phosphate and 1.0 parts of a sulfurized polybutylene (product sold by Lubrizol Corp. under name Anglamol 32) were added. The sulfurized polybutylene contains about 45 wt. % S. When the formulation was complete, the same was subjected to a Timken test (ASTM D 2509) first at 40 lbs. load and then 50 lbs. load. The Timken test is a test wherein a ring is rotated against a fixed block at a specified loading. The test is performed at room temperature for a period of 10 minutes. Following the test, the test block is examined and if no evidence of scoring is observed, the grease is considered to "pass" at that loading stage.

The grease prepared in this example containing tricalcium phosphate and a sulfurized polybutylene in a 3:1 weight ratio passed the Timken test at both the 40 and 50 lb. loads.

EXAMPLE 2

In this example, and for purposes of comparison, a formulation identical to that prepared in Example 1 was prepared except that the sulfurized polybutylene was not used. The resulting grease failed the Timken test at both the 40 and 50 lb. loads.

EXAMPLE 3

In this example, and again for purposes of comparison, a composition identical to that of Example 1 was prepared except that the tricalcium phosphate was omitted. The resulting composition passed the Timken test at the 40 lb. load, but failed at the 50 lb. load.

EXAMPLE 4

In this example, a composition identical to that of Example 1 except that an equal weight amount of a zinc dialkyl dithiophosphate was substituted for the polybutylene. The dialkyl dithiophosphate had a sulfur content of 18.2%, a phosphorus content of 9.0% and a zinc content of 10.4%. The resulting composition passed the Timken test at 40 lbs. but failed at 50 lbs.

EXAMPLE 5

In this example, and for purposes of comparison, a composition identical to that of Example 4 was prepared except that the tricalcium phosphate was omitted. The resulting composition failed the Timken test at both the 40 and 50 lb. loads.

From the foregoing, it is believed readily apparent that the use of an insoluble phosphorus compound such as tricalcium phosphate when combined with a sulfurized olefin polymer such as sulfurized polybutylene exhibits surprising and unexpected extreme pressure properties when used in a grease composition and similar results are achieved when a zinc dialkyl dithiophosphate is substituted for the sulfurized polybutylene.

What is claimed is:

1. A lubricating grease composition comprising a major proportion of a base oil stock, a thickener and an additive package made up of an oil insoluble phosphorus compound selected from the group consisting of alkali metal and alkaline earth metal salts of a phosphorus acid and an oil soluble sulfur compound selected from the group consisting of sulfurized hydrocarbons and organometallic sulfur salts.

2. The composition of claim 1 wherein said sulfur compound contains from 1 to 32 carbon atoms.

3. The composition of claim 2 wherein said phosphorus compound is a salt of an alkali metal or alkaline earth metal selected from the group consisting of lithium, sodium, potassium, calcium, strontium, barium and magnesium.

4. The composition of claim 3 wherein from about 0.3 to about 15% by weight of said phosphorus compound and from about 0.05 to about 5% by weight of said sulfur compound are used, both based on the total composition weight.

5. The composition of claim 4 wherein said sulfur compound is a sulfurized olefin prepared from aliphatic or terpenic olefins having 10 to 32 carbon atoms.

6. The composition of claim 5 wherein the thickener comprises a lithium soap or an aluminum soap.

7. The composition of claim 6 wherein said phosphorus compound is tricalcium phosphate.

8. The composition of claim 7 wherein said sulfur compound is sulfurized polybutylene.

9. The composition of claim 6 wherein said phosphorus compound is zinc dialkyl dithiophosphate.

10. The composition of claim 9 wherein said sulfur compound is sulfurized polybutylene.

11. The composition of claim 8 wherein from about 0.5 to about 5.0% by weight of said phosphorus compound and from about 0.1 to about 3.0% by weight of said sulfur compound are used, both based on total composition weight.

* * * * *

UNITED STATES PATENT OFFICE

CERTIFICATE OF CORRECTION

PATENT NO. : 4,107,058

DATED : August 15, 1978

INVENTOR(S) : George A. Clarke and Gary L. Harting

It is certified that error appears in the above-identified patent and that said Letters Patent are hereby corrected as shown below:

Claim 9, lines 1 and 2, "phosphorus" should read --sulfur--.

Claim 10, line 1, "sulfur" should read --phosphorus-- and on line 2, "sulfurized polybutylene" should read --tricalcium phosphate--.

Signed and Sealed this

*Tenth* Day of *June 1980*

[SEAL]

*Attest:*

SIDNEY A. DIAMOND

*Attesting Officer*

*Commissioner of Patents and Trademarks*